US005535821A

United States Patent [19]

Potier

[11] Patent Number: 5,535,821

[45] Date of Patent: Jul. 16, 1996

[54] HEAT EXCHANGER ESPECIALLY FOR A MOTOR VEHICLE

[75] Inventor: Michel Potier, Rambouillet, France

[73] Assignee: Valeo Thermique Moteur, Le Mesnil-Saint-Denis, France

[21] Appl. No.: 238,930

[22] Filed: May 6, 1994

[30] Foreign Application Priority Data

May 11, 1993 [FR] France ..... 93 05650

[51] Int. Cl.[6] ..... F28F 9/013

[52] U.S. Cl. ..... 165/173; 165/175; 165/906; 165/DIG. 477

[58] Field of Search ..... 165/76, 151, 153, 165/173, 175, 174, 906; 29/890.043, 890.052

[56] References Cited

U.S. PATENT DOCUMENTS

| | | | |
|---|---|---|---|
| 3,411,196 | 11/1968 | Zehnder | 165/175 |
| 4,971,145 | 11/1990 | Lyon | 165/173 |
| 5,062,476 | 11/1991 | Ryan et al. | 165/173 |
| 5,107,926 | 4/1992 | Calleson | 165/173 |
| 5,168,925 | 12/1992 | Suzumura et al. | 165/176 |
| 5,183,107 | 2/1993 | Le Gauyer | 165/174 X |
| 5,251,694 | 10/1993 | Chigira | 165/173 |
| 5,311,934 | 5/1994 | Potier | 165/173 X |
| 5,343,620 | 9/1994 | Velluet | 29/890.043 |

FOREIGN PATENT DOCUMENTS

| | | | |
|---|---|---|---|
| 2269054 | 11/1975 | France | 165/174 |
| 3936918 | 11/1990 | Germany | 165/176 |
| 2048451 | 12/1980 | United Kingdom | 165/906 |

*Primary Examiner*—Leonard R. Leo
*Attorney, Agent, or Firm*—Morgan & Finnegan

[57] ABSTRACT

A heat exchanger comprises an array of finned tubes in which the ends of the tubes are tightly fitted into holes formed in a collecting plate on which a collecting box is mounted. Stop means are provided between the collecting box and at least one tube end to prevent axial displacement of the tube during service.

6 Claims, 2 Drawing Sheets

HEAT EXCHANGER ESPECIALLY FOR A MOTOR VEHICLE

BACKGROUND OF THE INVENTION

This invention relates to a heat exchanger, especially for a motor vehicle.

More particularly, the invention relates to a heat exchanger of the kind comprising a collecting plate provided with a plurality of substantially circular holes, and an array of tubes provided with fins, in which each tube comprises a shaped end, tightly mounted in one of the holes in the collecting plate.

The expression "substantially circular" used herein means that the holes of the collecting plate and the corresponding sections of the ends of the tubes have a circular shape or a shape which may be oval or elliptical determined by a large axis and a small axis of symmetry.

In this kind of heat exchanger, the tightness between each tube end and the collecting plate is most frequently ensured by a joint made from elastomer in the form of a compressible collar which is compressed between the end of the tube and a collar bordering the corresponding hole in the collecting plate. Each tube end may be provided with a bell-mouth obtained by the deformation of the wall of the tube, the function of this deformation being to ensure the retention of the collecting plate on the array of finned tubes and to contribute towards the seal between the tube and the collecting plate.

Furthermore, it is possible to mount a fluid collecting box on one of the ends of the array Of finned tubes thus formed and more particularly on the collecting plate so as to form a heat exchanger.

When used in extreme conditions for this kind of heat exchanger, a phenomenon is produced by which a force directed axially of the tubes has a tendency to move certain tubes in relation to the collector by sliding them in the holes in the collecting plate.

The result of this is to bring about a loss in tightness between the end of the tubes in question and the holes and, in extreme cases, a deterioration of the joint provided between the end of the tube and the hole.

The present invention proposes to minimise or eliminate the above-mentioned problem.

SUMMARY

The invention proposes a heat exchanger, especially for a motor vehicle, comprising an array of tubes provided with fins in which the tube ends are tightly fitted into holes formed in a collecting plate on which is mounted a collecting box, wherein stop means are provided between the collecting box and at least one tube end which engages said tube end.

In consequence, the displacement of the entire tube in question is limited or even prevented by the stop means.

According to a preferred characteristic of the invention, the stop means consist of a finger extending from the collecting box. Alternatively, the stop means may consist of a rib extending from the collecting box.

In another preferred characteristic of the invention the stop means originate from the top wall of the collecting box; alternatively the stop means may originate from at least one lateral wall of the collecting box.

Preferably, the stop means rest on the free edge of the end of the respective tube; the stop means may have a plane surface in contact with the end of the tube.

BRIEF DESCRIPTION OF THE DRAWINGS

Other characteristics and advantages of the invention will become apparent from the following description with reference, by way of example, to the attached drawings, in which.

DETAILED DESCRIPTION OF THE PREFERRED EMBODIMENTS

Figure 1:
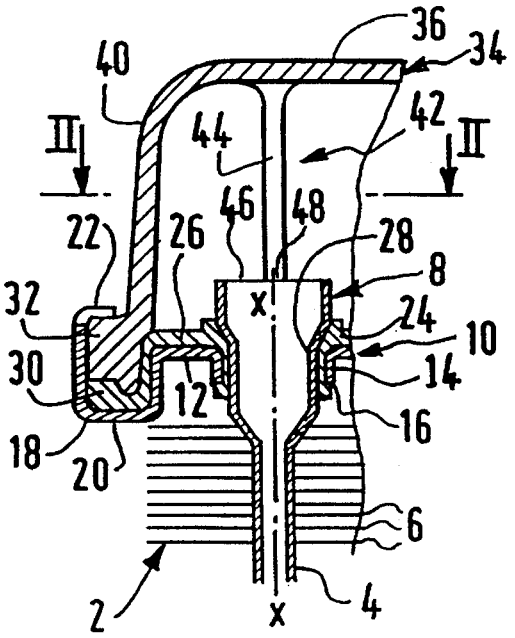
FIG. 1 is a partial view in longitudinal section along line I—I of FIG. 2 showing one embodiment of heat exchanger according to the invention.
Figure 2:
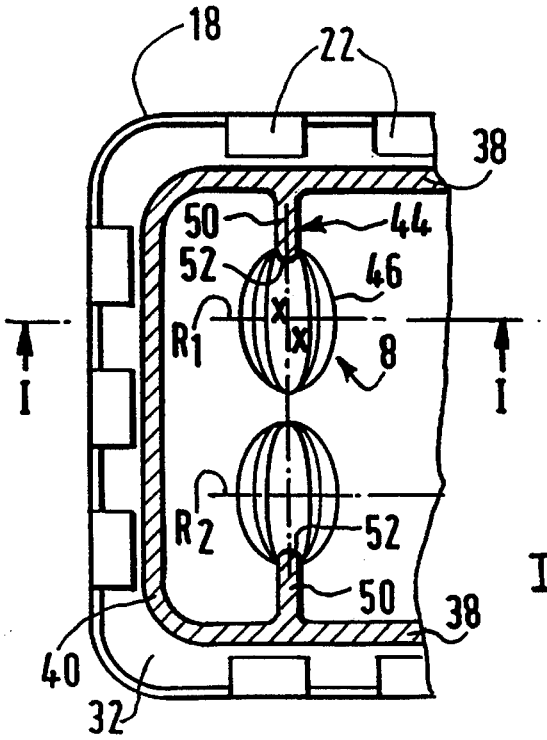
FIG. 2 is a partial sectional view along line II—II of FIG. 1.

Reference is made to FIGS. 1 and 2 which show a heat exchanger comprising an array 2 formed by a multiplicity of tubes 4 with respective parallel axes XX disposed in two parallel rows R1, R2.

The tubes are provided with a multiplicity of fins 6, which extend perpendicular to the axes XX of the tubes.

The ends 8 of the tubes 4 are tightly fitted into a collecting plate 10 which comprises a web 12 having a general rectangular shape, through which are provided, to correspond with the ends 8 of the tubes 4, a multiplicity of holes 14 of a shape corresponding to the shape of the tube ends 8; each of the holes is bordered by a collar 16 extending in the direction of the fins 6.

As can be seen in FIG. 1, the collecting plate 10 comprises a peripheral flange 18 delimiting a peripheral groove 20 and forming a multiplicity of deflectable lugs 22.

On the face of the collecting plate opposite the fins 6 is disposed a compressible joint 24, preferably made from an elastomer material.

This joint comprises a web 26 applied against the web 12 of the collecting plate and provided with compressible collars 28 which can be compressed between each collar 16 of the collecting plate 10 and the respective end 8 of the tube 4 by appropriate means, such as a forced assembly of the end 8 in the collars 28, or by the bell-mouthing of the said ends 8, as is known per se.

The web 26 of the joint 24 is provided with a flange 30 housed in the groove 20 and intended to be compressed by a peripheral edge 32 of a collecting box 34.

The seal between the collecting box 34 and the collecting plate 10 is ensured by compressing the flange 30 after the deflection of the lugs 22 of the collecting plate.

The collecting box 34 is bowl-shaped, and its open edge substantially corresponds to the peripheral edge 32 and comprises a base wall 36 opposite the open edge whilst being disposed substantially parallel t6 the collecting plate 10, this base wall connecting the peripheral edge 32 by longitudinal lateral walls 38 and transversel lateral walls 40.

The general structure of the heat exchanger, as described herein, is known per se and will not be described in further detail.

According to the invention, the collecting box 34 is provided with stop means 42 which limit or prevent axial displacement of the tubes 4 in the holes 14 of the collecting plate 10 and more particularly at the level of the collars 28 of the joint 24, these stop means being disposed in the vicinity of at least one tube end.

As can be seen in FIG. 1, the stop means consists of a finger 44 originating from inside the collecting box 34 and, more particularly in-the case of this figure, from the internal face of the base wall 36 to end at the edge 46 of the end 8 of the tube in question, which edge is substantially perpendicular in relation to the axis XX of the tube whilst being disposed at a distance from the base wall 36 of the collecting box 34.

More particularly, with reference to FIG. 2, the free end 48 of the finger 44, which has a plane surface substantially parallel to the edge 46, rests on a localised region of the edge 46 of the tube wall so as not to obstruct the circulation of the fluid through this tube, this finger being situated in the vicinity of the end 8 but eccentrically in relation to the axis XX of the tube 4 whilst having the largest part of its body outside the perimeter delimited by the edge 46.

Furthermore, as better shown in FIG. 2, the stop means may instead comprise a rib 50 originating from the longitudinal lateral wall 38 of the fluid box and resting by its free edge 48 on a localised region of the edge 46 of the end 8 of the tubes 4, this rib extending completely or partly along this lateral wall whilst being substantially parallel to the axis XX of the tube and whilst having an end part 52, opposite wall 38, spaced from axis XX of the tube 4.

The rib 50, described above, may also originate from the transversal lateral wall 40 of the collecting box 34 and rest on a localised region of the edge 46 of the end 8 of the tube 4.

As can be seen in FIG. 2, a rib 50 may be associated with a tube 4 of each row R1, R2 of the bank of finned tubes.

As a result of the stop means comprising either a finger or a rib, disposed in the vicinity of the tubes in question, the tubes are not able to undergo axial displacement along their axis XX and for this reason a perfect seal between the ends of these tubes and the collecting plate is guaranteed.

Figure 3:
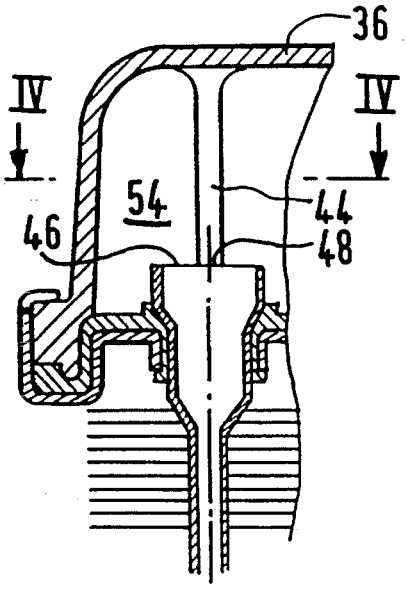
FIG. 3 is a partial view in longitudinal section along line III—III of FIG. 4 showing a second embodiment of heat exchanger according to the invention.
Figure 4:
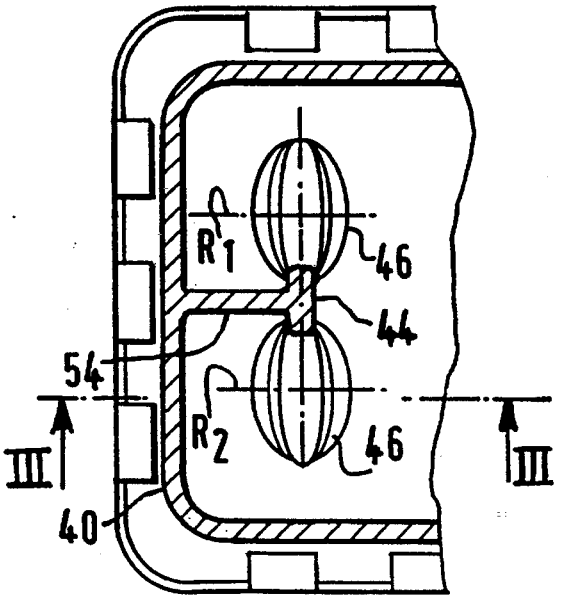
FIG. 4 is a partial sectional view along line IV—IV of FIG. 3.

Reference is now made to FIGS. 3 and 4, which show a refinement of the invention and which, for this purpose, are given the same references.

In this refinement, a finger 44 originates from the base wall 36 of the collecting box 34 whilst being situated between two adjacent tubes 4 situated on two rows R1, R2.

This finger, as can be seen in FIG. 4, has a parallelepiped-shaped section so that, at the level of its free end 48, the small sides of the finger come to rest on the edges 46 of the ends 8 of the two adjacent tubes.

Finger 44 can be connected to the lateral transversel wall 40 of the collecting box by a flange 54 originating from a longitudinal edge of this finger and terminating at the said lateral transversel wall.

This finger and the associated flange form stop means for two adjacent tubes.

Figure 5:
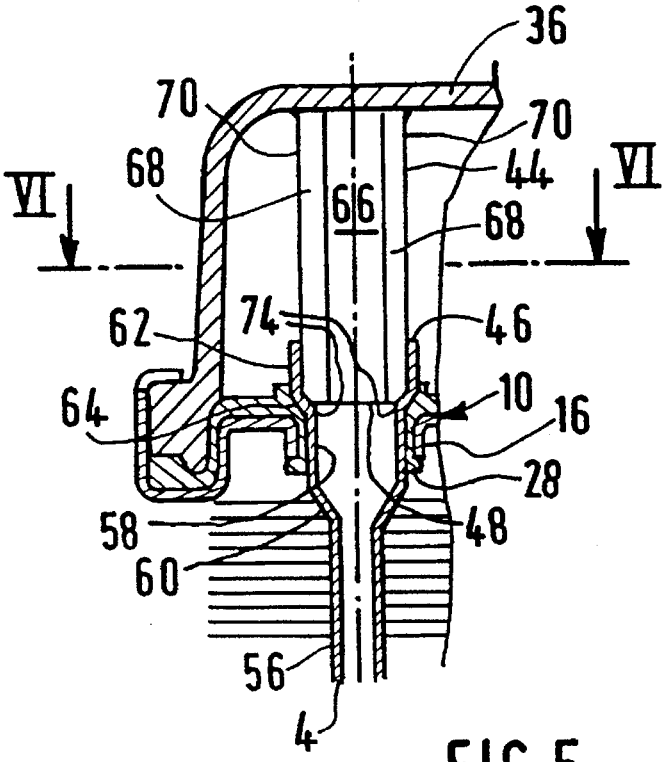
FIG. 5 is a partial view in longitudinal section along line V—V of FIG. 6 showing a third embodiment of heat exchanger according to the invention.
Figure 6:
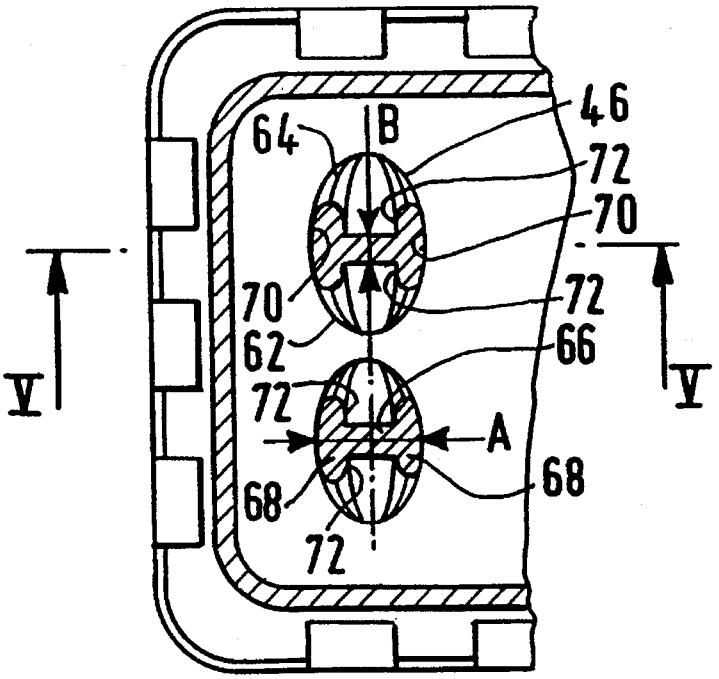
FIG. 6 is a partial sectional view along line VI—VI in FIG. 5.

Reference is now made to FIGS. 5 and 6 which show another embodiment of the invention.

As can better be seen from these figures, the end 8 of each tube 4 is tightly mounted in the collecting plate 10 by deformation of this end, which is produced during an operation known as bell-mouthing.

This bell-mouthing operation, (known from the prior art), consists of increasing the section of the body 56 of the tube 4 at the level of its junction with the collecting plate 10 so as to compress the collar 28 disposed between the outer wall of this end and the collar 16 of the collecting plate by forming a first bell-mouth 58.

In consequence of this operation, a seal is ensured between the end 8 of the tube 4 and the collecting plate 10, and the tube 4 has a radial shoulder 60 situated between the body 56 of the tube and the first bell-mouth 58.

Preferably, the operation forms a second bell-mouth 62 following the first bell-mouth towards the free edge 46 of the end 8, this second bell-mouth, having a larger diameter than the first bell-mouth, enabling the tube 4 to be stopped in the hole 14.

The result of this second bell-mouth 62 is to create a second shoulder 64 disposed at a distance from the first shoulder 60 of the first bell-mouth 58, whilst being situated between the first bell-mouth and the second bell-mouth.

With such an arrangement, the stop means 42 rest on the end 8 of the tube 4 by engaging a shoulder, either shoulder 60 of the first bell-mouth 58, or shoulder 64 of the second bell-mouth 62.

To achieve this there is provided a finger 44 originating from the base wall 36 of the collecting box, the free end 48 of the finger penetrating either the first bell-mouth 58 or the second bell-mouth 62 whilst resting by the said free end on the respective shoulder.

As shown in FIG. 5, the free end 48 of the finger 44 rests on the second shoulder 64 of the second bell-mouth 62 and has, in section, (as can be seen in FIG. 6), a shape according to which a substantially rectangular body 66 at each end bears a guide portion 68 having a greater transversal thickness. These guide portions comprise a portion having an outer cylindrical surface 70 with a diameter substantially corresponding to the diameter of the respective bell-mouth, in this case bell-mouth 62, and two vertical walls 72 connecting the body 66 of the finger 44.

The distance A between the portions of the cylindrical surfaces 70 preferably corresponds substantially to the diameter of the portions of the end incorporating this bell-mouth, in this case bell-mouth 62, and two vertical walls 72 connecting the body 66 of the finger 44.

Preferably, and as can be seen on FIG. 6, which shows oval tube ends formed with bell-mouths, the distance A between the cylindrical surface portions corresponds substantially to the small dimension of the oval of the bell-mouth and the free end 48 bears a support surface 74 having an inclination corresponding to the inclination of the shoulder on which it rests, and the thickness B of the body 66 is sufficiently small so that it interferes as little as possible with the circulation of the fluid in the tube.

The present invention is not restricted to the embodiments described but includes all variations within the scope of the appended claims.

In particular, the description of the preferred embodiments takes into account stop means for a tube and/or for two adjacent tubes of two different rows; these stop means may in practice be used for several tubes each comprising a separate stop means and/or for two adjacent tubes belonging to the same row.

What is claimed is:

1. A heat exchanger suitable for a motor vehicle, comprising an array of finned tubes, said tubes each having a respective elliptical bell-mouth end, a collecting plate having a plurality of holes corresponding to the shape of said respective bell-mouth ends formed therein in which said bell-mouth ends of said tubes are each tightly fitted into an associated one of said bell-mouth holes, a collecting box having at least one lateral wall, said collecting box being mounted on said collecting plate, and stop means provided between said collecting box and at least one of said respective bell-mouth tube ends for enabling said stop means to engage at least a portion of said respective bell-mouth tube and thereby to prevent axial displacement of said tube associated with said respective bell-mouth tube end, said stop means having an individual finger for each of said tubes, said fingers being transversely disposed relative to said lateral wall of said collecting box and extending from said collecting box toward said respective tubes, each of said fingers being disposed parallel to a major axis of said respective elliptical bell-mouth tubes.

2. A heat exchanger according to claim 1, wherein said stop means extends from said at least one lateral wall of said collecting box.

3. A heat exchanger according to claim 1, further comprising a flange for connecting said stop means to at least one of said lateral walls of said collecting box.

4. A heat exchanger according to claim 1, wherein said stop means are located between the ends of at least two adjacent tubes.

5. A heat exchanger according to claim 1, wherein said stop means has a plane end, said plane end providing a support surface for engaging said respective bell-mouth tube end.

6. A heat exchanger according to claim 1 further comprising a seal having a collar interposed between one of said bell-mouth tube ends and said corresponding shaped collecting plate hole in which said tube is fitted.

* * * * *